United States Patent [19]

Storie et al.

[11] 4,253,090

[45] Feb. 24, 1981

[54] CONTACTLESS BALL SHOOTER APPARATUS FOR PINBALL GAME

[75] Inventors: David D. Storie, Santa Clara; Sholom Kass, Sunnyvale, both of Calif.

[73] Assignee: Atari, Inc., Sunnyvale, Calif.

[21] Appl. No.: 82,432

[22] Filed: Oct. 5, 1979

[51] Int. Cl.[3] ..... G08B 23/00; F41B 7/00

[52] U.S. Cl. ..... 340/323 R; 124/16

[58] Field of Search ..... 340/323; 324/207, 208, 324/176, 178, 179, 160; 73/5, 141 AB, DIG. 3, 493, 503, 510, 518; 273/85 G, 85 R, 85 E; 124/7, 16, 21, 27, 32

[56] References Cited

U.S. PATENT DOCUMENTS

| | | | |
|---|---|---|---|
| 3,297,866 | 1/1967 | Lippmann et al. | 324/208 |
| 3,373,612 | 3/1968 | Thompson et al. | 324/178 |
| 3,567,951 | 3/1971 | Montgomery, Jr. et al. | 324/178 |
| 4,093,917 | 6/1978 | Haeussermann | 324/207 |
| 4,107,604 | 8/1978 | Bernier | 324/208 |
| 4,124,814 | 11/1978 | Lauerman | 324/208 |
| 4,180,726 | 12/1979 | De Crescent | 324/178 |

*Primary Examiner*—Donald J. Yusko

*Attorney, Agent, or Firm*—Townsend & Townsend

[57] ABSTRACT

Apparatus for use in shooting an imaginary ball of an electronic pinball game which has score display means comprising a shaft or plunger which shifts longitudinally in a forward direction after being pulled rearwardly and released. Detecting means adjacent to the longitudinal path of travel generates electronic signals as a function of the movement of the shaft and the signals are used as a measure of the speed and direction of the shaft, and the signals are applied to circuitry which operates scoring and other devices controlling the display means. In one embodiment, the detecting means comprises a pair of Hall effect detectors which are longitudinally spaced apart and are actuated by magnets carried by the shaft. In a second embodiment, the detecting means includes a pair of spaced photocells, respective light sources for the photocells, and an opaque tab carried by the shaft for movement between each photocell and its light source. The time interval between the actuation of the first photocell and the actuation of the second photocell is a measure of the speed of the shaft and is proportional to the force exerted by the shaft on the imaginary ball. The circuitry which operates the scoring and other electronic devices associated with the display means can then provide the output to the display means in accordance with the magnitude of the generated signals.

8 Claims, 7 Drawing Figures

CONTACTLESS BALL SHOOTER APPARATUS FOR PINBALL GAME

This invention relates to improvements in electronic pinball games and, more particularly, to a pinball game which is operated without the actual balls being used.

BACKGROUND OF THE INVENTION

Conventional pinball games, as is well known, are constructed to permit successive shooting of a group of balls, such as five in number, so that the balls will move over a game board to strike bumpers and other obstacles which are electronically coupled to a display means indicating scores and other incidents of the play of the game. While such a game provides enjoyment and stimulates the competitive interests for one or more players, it requires only limited skills and its capability to stimulate interest progressively diminishes so as to present less of a challenge to pinball players whose skills are well developed. Becaue of these drawbacks, a need has arisen for an improved electronic pinball game which provides for a greater challenge than the conventional games of this type, especially a challenge which can be met by the use of electronics alone rather than by reliance on the combination of electronics and the rolling of balls across a game board.

SUMMARY OF THE INVENTION

The present invention satisfies the aforesaid need by providing an improved ball shooter apparatus for use with an electronic pinball game in which the balls are imaginary and the results of the act of shooting a ball is determined solely by the way in which the ball-shooting plunger or shaft is manipulated during the act of shooting. To this end, the present invention provides a shaft or plunger which is pulled back and released in the usual manner of the ball-shooting shaft of a conventional pinball game. However, in the present invention, the shaft does not strike a ball but the movement of the shaft is sensed and transformed into electronic signals for use in operating the scoring and other electronic devices of the game which control the score display means. In this way, the player of the game relies completely upon the way the shaft is manipulated to obtain a maximum score rather than rely upon the movement of an actual ball.

The detector means of the present invention is located adjacent to the path of travel of the shaft and is operable to detect not only the speed of the shaft but also its direction of travel. In one embodiment of the invention, a pair of Hall effect detectors are arranged in spaced apart locations longitudinally of the shaft, and the shaft is provided with magnetic means which successively actuate the detectors to provide signals which can be used as a measure of the speed of the shaft and as an indication of the direction of movement of the shaft. The detectors are connected to circuitry which controls the score display means of the game itself.

In another embodiment of the apparatus, the detector means comprises a pair of spaced photocells, which each photocell having its respective light source, and an opaque tab carried by the shaft for passage between each photocell and its light source. The photocells generate signals at different times and the time interval between the generation of the signals can be used as a measure of the speed of the shaft. The signals are used to operate circuitry coupled with the score display means.

The primary object of this invention is to provide an improved apparatus for use with an electronic pinball game wherein the apparatus is operable to indicate the speed of movement of a plunger or shaft as it moves forwardly and strikes an imaginary ball whereby the detecting of the shaft movement can be used as a measure of the speed of the shaft to control scoring and other electronic devices which operate the score display means of the game.

Another object of the present invention is to provide apparatus of the type described which is simple and rugged in construction, can readily sense movement of the shaft, yet provide accurate measure of the speed of the shaft without requiring elaborate circuitry or other structure.

Other objects of this invention will become apparent as the following specification progresses, reference being had to the accompanying drawings for several embodiments of the invention.

IN THE DRAWINGS

Figure 1:
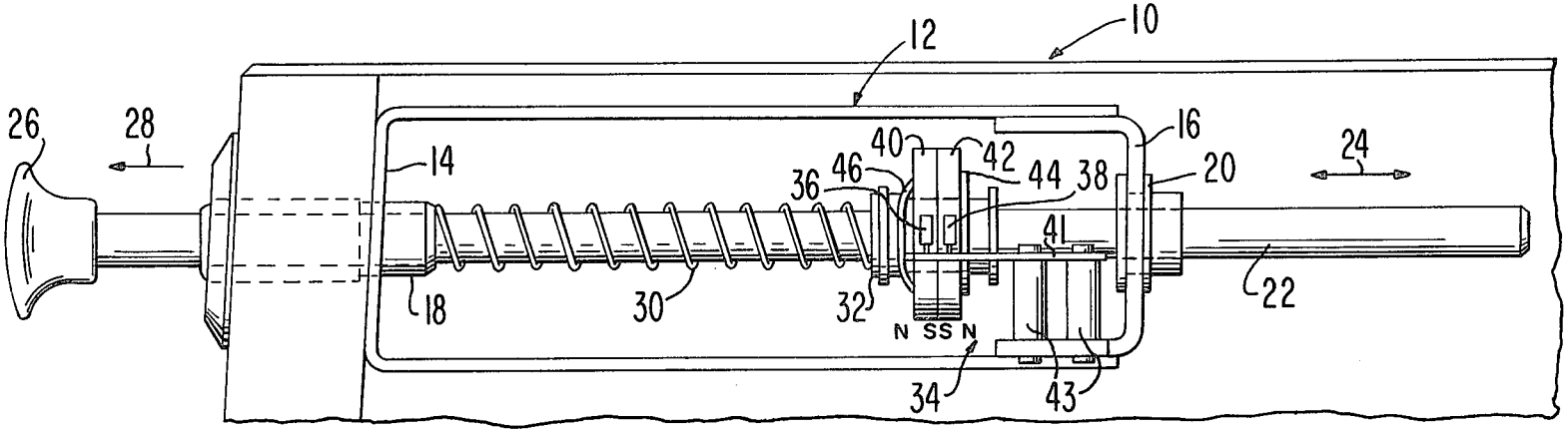
FIG. 1 is a side elevational view of a first embodiment of the contactless ball shooter apparatus of the present invention.
Figure 2A:
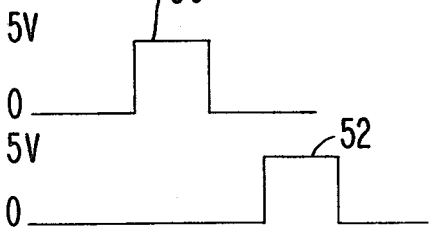
FIG. 2 is an end elevational view of the apparatus of FIG. 1.
Figure 3:
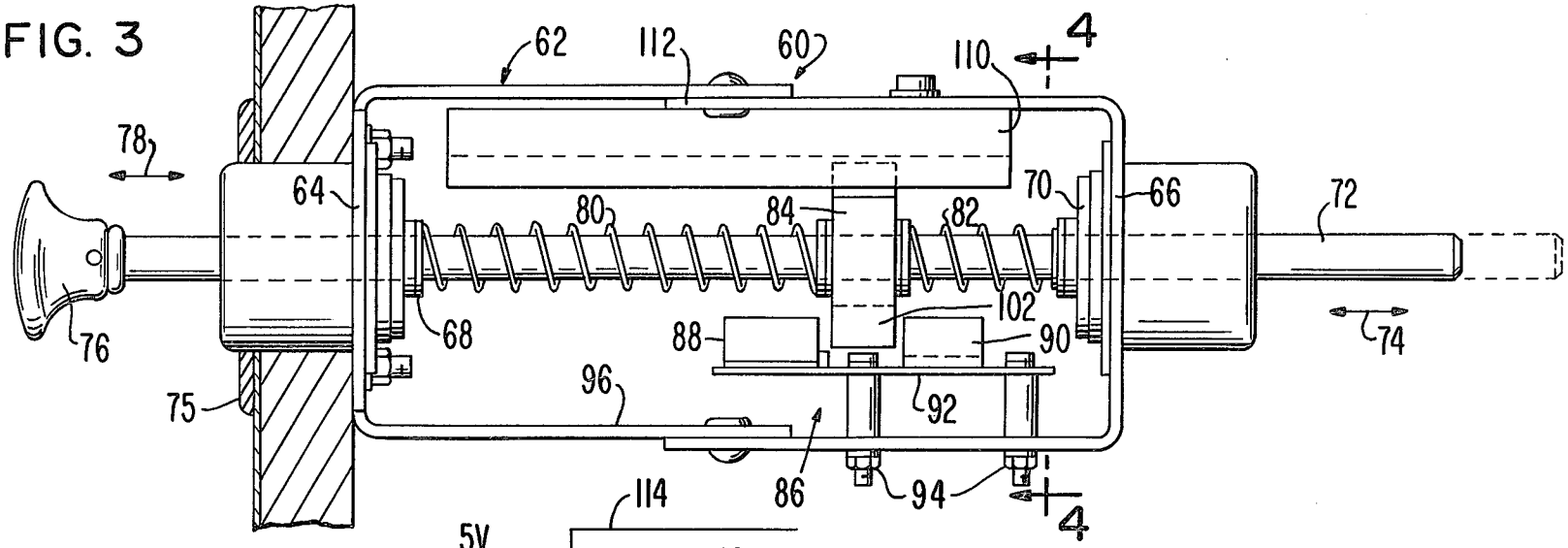
Figure 4:
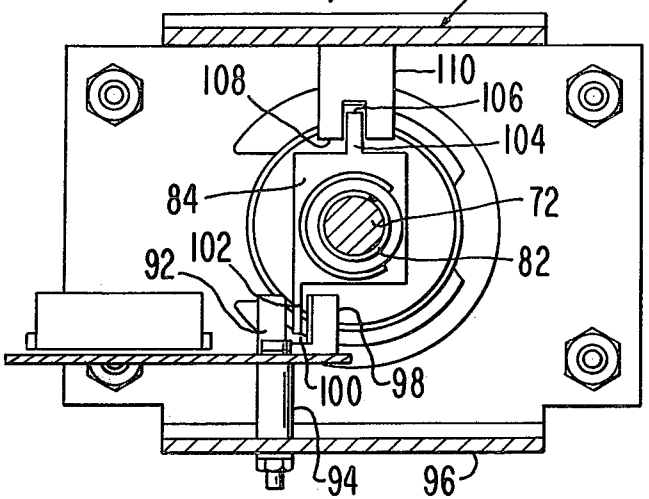
Figure 3A:
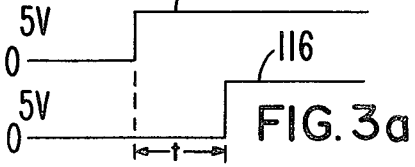
Figure 5:
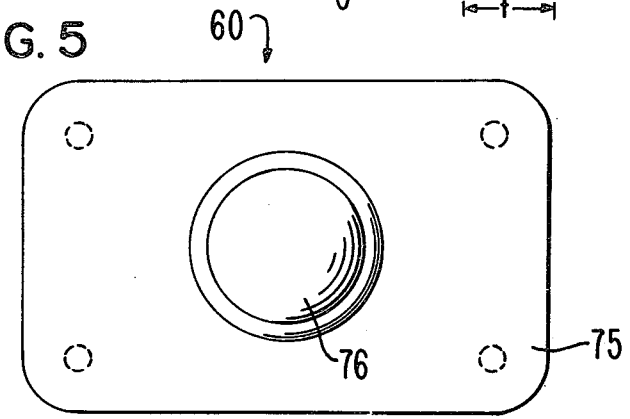

FIG. 2*a* is a timing diagram relating to the operation of the detecting means of the apparatus of FIG. 1;

FIG. 3 is a view similar to FIG. 1 but showing a second embodiment of the apparatus;

FIG. 3*a* is a timing diagram relating to the operation of the detecting means of the apparatus of FIG. 3;

FIG. 4 is a cross-sectional view taken along line 4—4 of FIG. 1; and FIG. 5 is a front end elevational view of the apparatus of FIG. 3.

Figure 2:
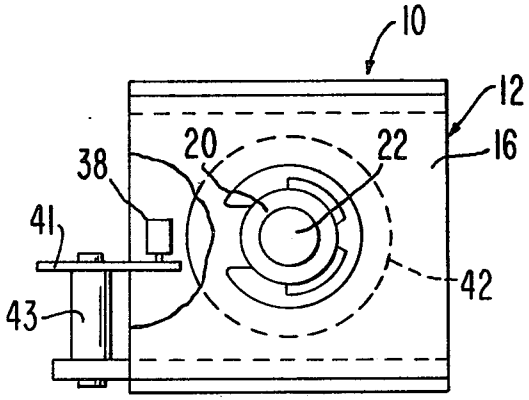

The contactless ball shooter apparatus forming a first embodiment of the present invention is shown in FIGS. 1 and 2 and is denoted by the numeral 10. Apparatus 10 includes a rigid open frame 12 having a pair of generally vertical end walls 14 and 16 provided with respective bearings 18 and 20 for shiftably mounting a shaft or plunger 22 for longitudinal movement back and forth in the directions of arrows 24 (FIG. 1). A knob 26 at the outer end of shaft 22 permits manual movement in the direction of arrow 28 against the bias force of a coil spring 30 surrounding shaft 22 and extending between and connected at the ends thereof to bearing 18 and a retaining ring 32 intermediate the ends of the shaft 22. Thus, when knob 26 is pulled to the left in the direction of arrow 28 when viewing FIG. 1 and then released, the shaft moves forwardly to the right of FIG. 1 under the influence of the restoring force of spring 30.

Apparatus 10 is to be used in an electronic ball shooting game in which the movement of shaft 22, upon being released after being pulled to the left when viewing FIG. 1, is designed to strike an imaginary ball and the movement of the speed of the shaft is detected by electronic detecting means hereinafter described, so that electronic signals can be generated to operate electronic circuitry (not shown) which registers scores and other incidents resulting from the shaft's striking the imaginary ball. The scores and incidents of play of the game are made visually observable on a display (not shown) much to the amusement and competitive satisfaction of the player of the game using apparatus 10.

To sense the speed and direction of movement of shaft 22, detecting means 34 is provided on apparatus 10, such means 34 being defined by a pair of Hall effect detectors 36 and 38 which are mounted adjacent to the path of travel of shaft 22 on a circuit board 40 secured by fasteners 42 to frame 12 as shown in FIGS. 1 and 2. The first detector 36 is used to determine the speed of shaft 22 and detector 38 is used to detect the direction of motion of shaft 22 as hereinafter described.

Detectors 36 and 38 are actuated by a pair of circular magnets 40 and 42 which are in substantial abuttment with each other and have their poles arranged in the manner as shown in FIG. 1, that is the outer, remote poles of the two magnets being the north poles and the inner, adjacent poles being the south poles. The magnets are held in place by retaining ring 32 and a second retaining ring 44, there being a curved washer 46 bearing against the adjacent face of magnet 40 to cushion any shock of the magnets and to allow for more tolerance.

In operation, when shaft 22 is pulled to the left in the direction of arrow 28 and then released, the restoring force of spring 30 causes the shaft to move forwardly to allow magnets 40 and 42 to successively move past detectors 36 and 38.

When detector 36 is actuated by the field represented by the north pole of magnet 42, the output of detector 36 remains unchanged. When detector 36 senses the south pole of magnet 42 a voltage is generated as indicated by pulse 50 in the timing diagram of FIG. 2*a*. The width of this pulse is inversely proportional to the speed of movement of shaft 22 and the generated signal representing the speed can then be used electronically in the circuitry associated with detector 36 to actuate the scoring and other devices which operate the visual display of the game.

Detector 38 is provided to distinguish between the directions of motion of shaft 22 when it is pulled back and released. Detector 38 causes a pulse 52 to be generated when the poles of magnets 42 and 40, respectively, move successively past detector 38. A logic circuit (not shown) enables the determination that shaft 22 has indeed moved in the forward direction. This is achieved by a circuit in which the signal pulse from detector 36 also disarms the system. The system is not re-armed until a pulse is obtained from detector 38. The necessary logic may be embodied either in software or hardware.

A second embodiment of the apparatus of this invention is broadly denoted by the numeral 60 and is shown in FIGS. 3–5. Apparatus 60 is essentially the same in construction as apparatus 10 except that apparatus 60 has an optical detecting means.

Apparatus 60 has a frame 62 provided with a pair of spaced end walls 64 and 66, the end walls being provided with respective bearings 68 and 70 for shiftably mounting a plunger or shaft 72 for movement in opposed directions indicated by arrows 74 (FIG. 3). A knob 76 on one end of shaft 72 allows the shaft to be pulled in the direction of arrow 78 against the bias forces of a pair of coil springs 80 and 82 surrounding shaft 72, spring 80 extending between bearing 68 and a follower member 84 rigid to shaft 72 intermediate its end. Spring 82 stands between follower 84 and bearing 70.

Apparatus 60 operates essentially for the same purpose as apparatus 10, namely, to simulate the striking of an imaginary ball by the end of shaft 72. By detecting the speed of movement of the shaft, an electronic signal can be generated which represents speed and such signal can be used with electronic circuitry and display means to provide scoring and other indications on a visual display.

To provide detection, optical sensing means 86 is provided which includes a pair of photocells 88 and 90 mounted on a circuit board 92 at locations longitudinally spaced apart with reference to shaft 72. Board 92 is carried by fasteners 94 on the bottom part 96 of frame 62. Each of photocells 88 and 90 has a respective light source spaced laterally therefrom, light source 98 being provided for photocell 90 and illustrated in FIG. 4. Photocell 90 and light source 98 present a gap 100 through which a tab 102 passes, the tab being secured to or integral with follower member 84 which is rigidly secured to shaft 72 for movement therewith. Tab 102 is opaque and blocks the light passing from light source 98 to photocell 90 as a function of the movement of shaft 72 in a forward direction, namely, a direction opposite to the direction of arrow 78 of FIG. 3. Similarly, photocell 88 and its respective light source (not shown) present a gap substantially the same as gap 100, and tab 102 also passes through this second gap. For guiding shaft 72 and preventing its rotation relative to frame 62, follower member 84 has a second tab 104 on its upper end for movement in a groove 106 in the bottom face 108 of a rigid bar 110 secured by suitable fasteners to the underside of the top part 112 of frame 62.

In use, shaft 72 is pulled to the left and then released, following which tab 102 successively breaks the light beam to photocell 88 to generate a first voltage 114 (FIG. 3*a*) and then blocks the light beam to photocell 90 to generate a second signal pulse 116, the time difference between the leading edges of pulses 114 and 116 being an inverse measure of the speed of movement of the shaft. This period is in the range of 5 to 15 milliseconds. The signals are then used to enable circuitry (not shown) coupled with the scoring and other devices which operate the visual display of the game.

We claim:

1. Apparatus for use with an electronic pinball game comprising: a shaft; means mounting the shaft for longitudinal movement in opposite directions with respect to a predetermined reference; means on the shaft for permitting the shaft to be manually grasped and pulled in one direction; means biasing the shaft in the opposite direction after the shaft has been moved in said one direction; and means adjacent to the path of travel for sensing the speed of movement of the shaft, said sensing means being operable to generate an electronic signal for operating an electronic circuit coupled to a score display means.

2. Apparatus as set forth in claim 1, wherein said sensing means comprises a Hall effect detector, and magnetic means carried by the shaft for actuating the detector to generate said signal as a function of the movement of the shaft relative to said reference.

3. Apparatus as set forth in claim 2, wherein said magnetic means includes structure defining a pair of spaced first poles of identical polarity and a second pole of opposite polarity, the second pole being between the first poles, the first poles being spaced from each other longitudinally of the shaft.

4. Apparatus as set forth in claim 3, wherein said magnetic means includes a pair of magnets in substantial abuttment with each other, each magnet having first and second magnetic poles of opposite polarity, a pole of one magnet being adjacent to the pole of the same polarity of the other magnet.

5. Apparatus as set forth in claim 4, wherein the magnets are circular.

6. Apparatus as set forth in claim 1, wherein said sensing means includes a pair of spaced photocells, a radiation source for each photocell, respectively, and means movable successively past the photocells for blocking the radiation thereto as a function of the movement of the shaft.

7. Apparatus as set forth in claim 6, wherein said blocking means comprises an opaque tab, and means connecting the tab to the shaft.

8. Apparatus as set forth in claim 7, wherein is included means coupled with the shaft for preventing rotation of the same about its longitudinal axis as the shaft moves longitudinally of the axis.

* * * * *